United States Patent [19]

Gerritsen et al.

[11] 4,049,263

[45] Sept. 20, 1977

[54] DIVING BOARD

[75] Inventors: Dirk J. Gerritsen, Eext; Marcus Kuipers, Annen, both of Netherlands

[73] Assignee: N. V. Tramposafe, Eext, Netherlands

[21] Appl. No.: 559,646

[22] Filed: Mar. 18, 1975

[30] Foreign Application Priority Data

Mar. 18, 1974 Netherlands ..... 7403632

[51] Int. Cl.[2] ..... A63B 5/10

[52] U.S. Cl. ..... 272/66; 273/DIG. 7

[58] Field of Search ..... 272/66, 65; 273/DIG. 7

[56] References Cited

U.S. PATENT DOCUMENTS

| | | | |
|---|---|---|---|
| 2,807,468 | 9/1957 | Patterson | 272/66 |
| 2,831,688 | 4/1958 | Knox | 272/66 |
| 2,965,529 | 12/1960 | Bright | 272/66 |
| 3,075,764 | 1/1963 | De Lorean | 272/66 |
| 3,493,240 | 2/1970 | Jenks | 273/DIG. 7 |
| 3,502,327 | 3/1970 | Meyer | 272/66 |
| 3,544,104 | 12/1970 | Jenks | 272/66 |
| 3,598,693 | 8/1971 | Andersen et al. | 273/DIG. 7 |
| 3,640,533 | 2/1972 | Davis | 273/DIG. 7 |

FOREIGN PATENT DOCUMENTS

| | | | |
|---|---|---|---|
| 1,428,844 | 11/1968 | Germany | 272/66 |
| 710,595 | 6/1954 | United Kingdom | 272/66 |
| 807,549 | 1/1959 | United Kingdom | 272/66 |

*Primary Examiner*—Anton O. Oechsle
*Assistant Examiner*—Harry G. Strappello
*Attorney, Agent, or Firm*—Karl W. Flocks

[57] ABSTRACT

A diving board comprising a layer extending over its full length, at least one of its upper and lower surfaces being provided with thin sheets of reinforcing material, said sheets having different lengths, the lengths of said sheets diminishing from the front and the rear ends of the diving board to a portion of said diving board lying between its both ends, which portion is destined for resting on a support of said diving board. The diving board has a light primary layer to take up part of the total bending force thereon with at least an upper or lower surface with reinforcing material provided so that the amount of reinforcing material is substantially adapted to the moment acting in each cross-section of the diving board.

6 Claims, 6 Drawing Figures

DIVING BOARD

BACKGROUND OF THE INVENTION

The present invention relates to a diving board for a swimming pool, said driving board being of the cantilever type having its rear end attached to a stationary support and resting on a fulcrum at a place between its front and rear ends. A driving board of the cantilever type is a diving board with a fixed or pivoting rear end and resting at a place between its front and rear ends on a fulcrum. The invention also relates to a method for the manufacture of such a diving board. The object of the present invention is to obtain a diving board with a practically unlimited durability without impairing other properties such as flexibility and inertia particularly under circumstances as usually prevail in public swimming pools, where the board is frequently used by the public as well as by top-drivers. The importance of the above mentioned properties will be elucidated hereunder.

The durability can be predicted on the basis of a fatique-bending test. If the front end is repeatedly deflected by a force of 500 kg and its withstands 100.000 cycles, before it breaks, it will show a lifetime of about 3 years in actual practice.

Since the object of the invention is to obtain a driving board having a practically unlimited lifetime, the constructions thereof to be described are calculated in such a way, that none of the used materials can be subjected to the maximum stress, which is allowable when fatique must be excluded.

In order to check the resistance against fatique a driving board according to the invention has been executed to a bending-test, which has been extended to more than 1.000.000 cycles. After said test not the slightest deformation of the diving board was detectable.

The flexibility of the board can be measured by the deflection of the front end under a certain static load.

For the best type of board, such as is used in international contents and Olympic Games, this deflection amounts from 13 to 21 cm per 100 kg, dependent on the place of the fulcrum, which — in accordance with the rules for driving boards of the "Federation Internationale de Natation Amateur" — must be adjustable by the diver.

The inertia, i.e., the inertia of the front end — in mechanics called the "reduced mass" is the property, which determines, whether the board gives the driver the experience of "light" or "heavy" behaviour of the board.

It should be clearly distinguished from the total mass of the board. It is actually the "apparent mass" of the front end. It could be defined as the mass, that ought to be fixed to the front end of a hypothetically weightless board, to give it the same dynamic behaviour as the real board possesses.

For a diving board of uniform cross-section this inertia amounts to one third of the mass of that part of the board that protrudes over the fulcrum in forward direction.

The inertia is however greatly reduced, if the front part of the part, that protrudes over the fulcrum is tapered towards the front end. This tapering also enlarges the flexibility. If carried out in the correct way it will not impair the bending-strength.

Tapering of the rear part towards the rear end also increases the flexibility, but hardly influences the inertia for a given fulcrum position. But, as the latter tapering increases the flexibility, at a constant fulcrum position, it allows a more forward position of the fulcrum for a required deflection of the front end. Therefore tapering towards the rear end will also reduce the inertia at a given deflection. The principle of tapering has been described in many patents (U.S. Pat. Nos. 2,070,494, 2,951,701, 2,805,859, U.K. Pat. Nos. 710,595, 746,647).

Tapering of driving boards towards both ends is nowadays general practice for diving boards of reasonable performance.

Up to the present the mutual connection between durability, flexibility and inertia is insufficiently recognised.

Improvement of one of these proportions without impairing the other properties, is the basic problem of the construction of a good diving board. All claims, often made that boards have a better performance or a better lifetime are worthless, if this mutual connection is not taken into account. The actual situation of the last 50 years, that swimming pool proprietors must make a choice between a board of excellent performance and a board with a very long lifetime, has not substantially changed. There is still a great demand for an excellent diving board, which lasts longer and the growing awareness that the supply of base materials is not unlimited gives a strong support to the design of more durable goods.

SUMMARY OF THE INVENTION

This has been the starting point for the design of the new type of the driving board according to the invention according to which said driving board comprises a primary layer substantially extending over its full length, said layer having a low density, at least one of its surfaces being provided with reinforcing material over at least a portion of said surface at both sides of said fulcrum.

The basic idea of the present invention is to use a primary layer which does not need to be tapered and which in itself can undergo the required deflection without surpassing the maximum allowable bending stress.

This primary layer cannot withstand the total bending force (500 kg) that is exerted in actual practice on the diving board, but usually only a rather small part of this force, say 20–30%. The maximum deflection may therefore already be achieved, when the front end is loaded with 100–150 kg. However, of this primary layer, preferably both upper and lower surface — and in special cases only one of these surfaces — are reinforced in a very special way, viz. such that the amount of reinforcing material is adapted to the particular moment, acting in each cross-section of the diving board.

Generally this means that the application of reinforcing material begins at a certain distance from the front end as well as from the rear end and that this amount increases almost lineary to the point of the most rear ward fulcrum position of the diving board.

Since the reinforcing material is usually applied in layers of different lengths, this would imply a stepwise increase of the amount of reinforcing material. In order to avoid such a stepwise increase according to the invention the amount of reinforcing material gradually may increase from a distance from at least one end of said diving board towards the place of the most rearward position of said fulcrum. In order to obtain this in an easy way the ends of the reinforcing sheets may have the shape of a triangle and may have their apexes on the longitudinal centre line of the diving board. A very important feature of the invention is, that also a combination of different materials can be used for one and the same diving board. Thus material which in itself is not very strong, but has a very low density, can be used at places, where low density is more important than strength.

On the other hand material of great strength and high density can be used at places, where strength is more important than low density.

Thus it may be of great advantage to use a material of low density for the primary layer and a material of very high strength as a reinforcing material.

The fact, that the reinforcing material is applied at places which lie as far as possible from the neutral line, means that practically all reinforcing material is subjected to its maximum allowable stress. Thus optimal use is made of the strength of this material.

It is also possible to use different materials for the upper and lower surfaces.

Reduction of the inertia is very important for the following reasons.

1. A board with a lower inertia will allow the diver to jump higher, because the energy left behind in the moving board, after the diver has left it, is not available to throw the diver upward.

This energy loss is proportional to the inertia for a given inertia of the front end.

2. From a viewpont of safety a low inertia should be preferred For it often occurs that a diver, after having left the board, collides on its front end with either head or limbs. The severeness of injury increases with the inertia of the board.

3. A board with a lower inertia will make it more suiteable for younger people.

In the past the high inertia of diving boards has often been the reason, why youngsters could not participate in the art of diving at an early age.

For the above described connection between durability, deflection and inertia it follows that inertia could certainly be further reduced if less rigid requirements would accepted for the durability.

BRIEF DESCRIPTION OF THE DRAWINGS

The invention will be further explained below with reference to the drawings showing diagrammatically and by way of example two embodiments of the diving board according to the invention and of the device for the manufacture of such a diving board.

The drawings show in

DESCRIPTION OF THE PREFERRED EMBODIMENTS

Figure 1:
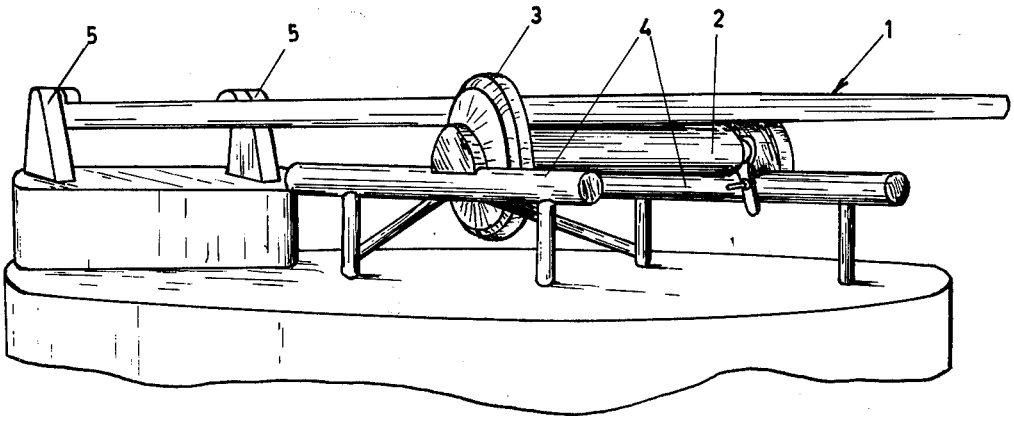
FIG. 1 the diving board according to the invention is perspective.

The diving board 1 shown in the FIGS. 1–4 rests between its ends on a roller 2 which is mounted rotatably in two side supports 3, which are slidably arranged on stationary tubes 4. The left end of said diving board may be attached to a stationay support 5. Said attachement may be made in such a way that said end is hingedly attached or fixedly secured to said support 5.

The diving board 1 comprises a primary layer 6 consisting of a plurality of hollow tubes 7, having a rectangular cross-section, of a resin reinforced with glass fibres. The lengths of said tubes 7 is substantially equal to the length of the diving board 1. The adjacent sides of said tubes 7 are bonded with one another by means of an expoxy resin or another thermo-setting resin.

It will be clear that said tubes may also have another cross-section, e.g., a square cross-section or that said primary layer 6 may consist of only one profile having a rectangular cross-section and being provided with longitudinal partition walls forming compartments therebetween.

The upper and the lower surfaces of said diving board 1 are provided with a plurality of reinforcing sheets or strips 8 having different lengths, adequatel, shaped to adapt the amount of material exactly to the moment acting in each cross-section, and consisting of a layer of thin steel wire, glass rovings or the like reinforcing threads embedded in a resin and covering a portion of the upper and lower surfaces of the diving board. The end portions of said reinforcing sheets 8 have, as appears from FIG. 2, the shape of a triangle. The apexes 9 of the triangular portions 10 of the sheets 8. At their one end point towards the rear end of the diving board 1 whereas the apexes 11 of the triangular portion 12 at their other end point towards the front end of the diving board. The apexes 9 and 11 of the triangular portions 10 and 12 of the sheets 8 lie on the longitudinal centerline 13 of the diving board and each apex of a triangular portion of a sheet 8 lies on the base 14 of a triangular portion of the adjacent sheet 8. Said bases 14 are shown in FIG. 2 in dotted lines.

Also the primary layer may consist of a plurality of hollow tubes of rectangular cross-section, bonded together with epoxy resin, and upper and lower surface of this primary layer may be reinforced with aluminium sheets, of different length and adequately shaped to adapt the amount of material exactly to the moment acting in each cross-section. Said sheets are bonded to the surface of the primary layer with epoxy resin.

The triangular portions 10 pointing with their apexes towards the rear end of the diving board 1 are arranged at the one side of the most rearward portion of the roller 2 and have perpendiculars which are smaller than the perpendiculars of the triangular portions 12 lying at the other side of the most rearward position of the diving board 1 lying at said one side of the roller 2 is stiffer than the portion of the diving board lying at said other side of said roller 2. In consequence of the fact that the apexes of the sheets 8 are arranged in this way the amounts of the reinforcing material applied on the upper and lower surfaces of the diving board gradually increase from a distance from the front and rear ends of the diving board towards the most rearward position of the roller 2.

Figure 2:
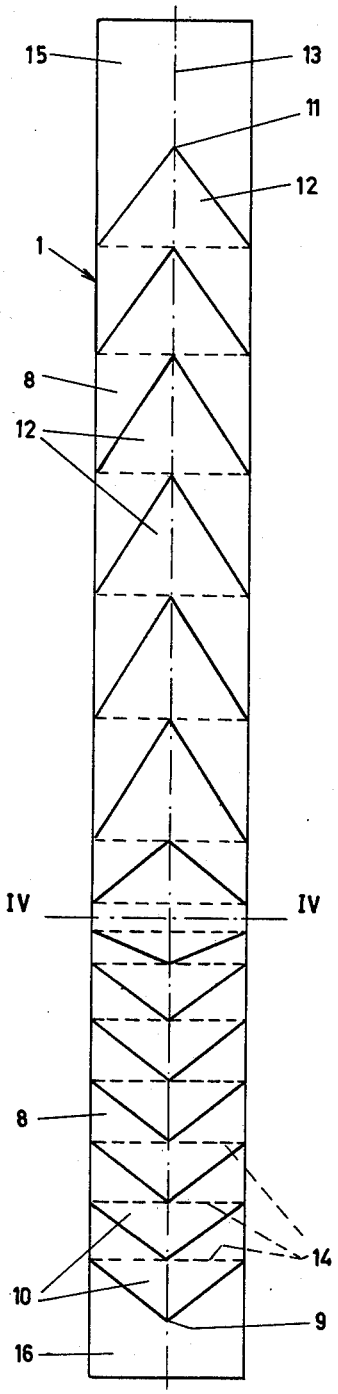
FIG. 2 is a top plan view of the diving board according to the invention.
Figure 3:
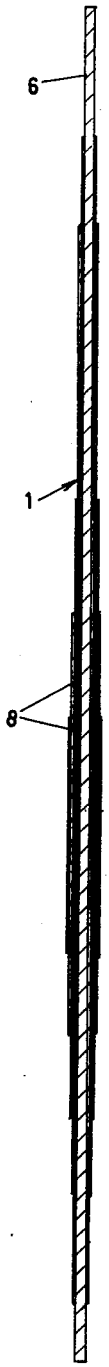
FIG. 3 a longitudinal section of the diving board according to FIG. 1.

As further appears from the FIGS. 1–3 the forward and rearward end portions 15 and 16 of the diving board are not provided with reinforcing sheets. Said end portions may taper to the ends of the diving board.

Figure 4:
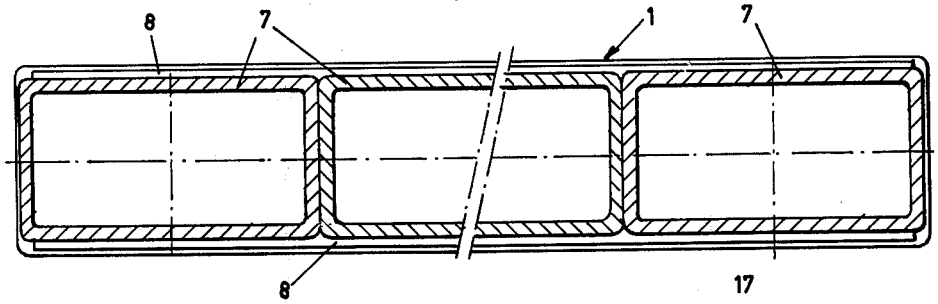
FIG. 4 a part of a cross-section along the line IV—IV in FIG. 1.

The diving board is provided with a covering 17 of fibre cloth as shown in FIG. 4.

The basic principle described above, can be applied to all sorts of material which are used for the manufacture of the diving board according to the invention, such as steel, aluminium, timber, as well as to synthetic resins reinforced with glass, carbon fibre, etc.

If e.g., aluminium is used the primary layer may consist of a sandwich-construction of two aluminium sheets, separated by a honeycomb of aluminium. In this case, the sides of the honeycomb have to be protected by a U-shaped profile.

Figure 5:
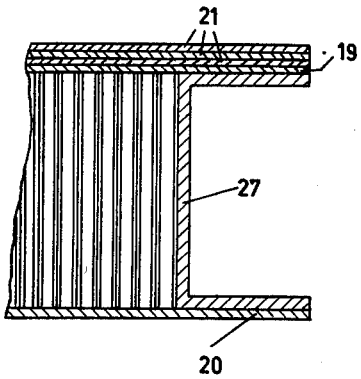
FIG. 5 a part of cross-section of the second embodiment on an enlarged scale.

FIG. 5 shows a portion of a cross-section of a diving board having a primary layer 18 consisting of honeycomb of aluminium. The upper surface as well as the lower surface of said honeycomb layer 18 is provided with an aluminium plate or strip 19,20 respectively. On the upper surface of the aluminium plate 19 there are arranged some thin reinforcing plates or strips 21. Said thin reinforcing plates 21 have substantially the same shape as the reinforcing sheets 8 of the first embodiment.

The primary layer 18 has somewhat smaller dimensions than the plates or strips 19,20, so that there is a space around said primary layer to connect said plates of strips 19,20 by means of U-shaped profiles 27 arranged in said space.

All parts of this diving board are bonded together by means of expoxy resin or another thermo-setting resin.

Thus e.g., in the above described aluminium-board, where the primary layer is a sandwich construction with a honeycomb core, the upper sheet of the sandwich and the reinforcing material may consist of 24 ST Alclad, whereas the lower sheet and its reinforcing material may consist of 75 ST Alclad, which material is particularly resistant against pressure forces. Also it is possible to reinforce an aluminium board of the type described in U.S. Pat. No. 2,805,859 either on top of the upper surface or underneath the upper surface and thus between the stiffeners with any type of reinforcing material, such as aluminium or wire sheet.

A very useful material for the primary layer consists of hollow profiles with rectangular cross-section, made according to the pull-extrusion-process of Koppers Comp., Pittsburgh, Pennsylvania U.S.A. The so-called EXL-profiles are produced by N.V. Nove, Hoogenzand, Netherlands. The profiles can be bonded together with a suitable thermo-setting resin. A very useful material for reinforcement of the upper and lower surfaces of the primary layer appeared to be the so-called wire sheet, as described in U.K. Pat. No. 1,088,491, Belgian Pat. No. 676,086, French Pat. No. 1,474,849, Italian Pat. No. 761,504, Swiss Pat. No. 441,727 and Canadian Pat. No. 734,835. This wire sheet consists of a plurality of parallel steel wires, embedded in a resin and interconnected by glass fibre and resin.

This wire sheet may be cut to the required length and width and can be bonded to the upper and lower surfaces of the primary layer, using a suitable thermo-setting resin. The binding is performed under pressure which is executed with the well known vacuum-bag-technique.

After application of the wire sheet the total board can be surrounded with an extra layer of glass fibre cloth and resin for proper finishing. The application of the above described principle does not exclude the possibility of applying some tapering as well.

In the case e.g., that the primary construction is not reinforced over its full length, tapering, applied to the non-reinforced ends may give an additional increase of the flexibility and reduction of the inertia. On the other hand, adequate reinforcing of the upper and lower surface can still be applied in cases, where the core has not a uniform cross-section, but the latter would only mean a partial abandonment of the maximum result that can be achieved.

Using EXL-profiles with dimensions 80 × 43 × 3 mm, boards of different length can be made (width 48 cm).

The maximum deflection under a static load of 100 kg, with fulcrum in its most rearward position, appeared to be 25,6 cm for a length of 480 cm
21,2 cm for a length of 440 cm
17,9 cm for a length of 400 cm.

It appeared further that the inertia (reduced mass) of all of these boards was practically the same for a given deflection.

For a deflection of 21 cm per 100 kg this inertia amounts to 5.8 kg.

For a deflection of 14 cm per 100 kg this inertia amounts of 4.5 kg.

For the best aluminium board now existing the inertia amounts to about 8–9 kg at a deflection of 21 cm per 100 kg.

The primary layer need not necessarily to be hollow, as described above for aluminium honeycomb or tubes or glass-reinforced resin, but may also be made of a solid material such as timber or a synthetic material of low density, e.g., a foamy resin or a resin in which tiny hollow spheres are used as a filler material to reduce the density. The reinforcing material for the upper and lower surface of the primary layer need not necessarily to be of low density. Even if material of rather high density, such as steel is used, this high density only little contributes to the inertia of the board, because the main part of this reinforcing material is concentrated in the environment of the fulcrum.

Figure 6:
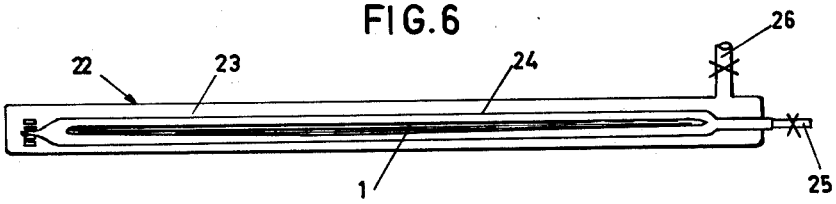
FIG. 6 on a small scale a device for the manufacture of a diving board.

FIG. 6 shows diagrammatically a device 22 for the manufacture of a diving board according to the invention. Said device consists of a container 23 which contains a bag 24 of a synthetic material, rubber or the like material provided with a conduit 25 which is connected with a vacuum pump. After having inserted a diving board in said bag 24 before the resin binding its layers has been set, said bag is evacuated so that the air pressure passes said bag against the diving board so that the layers of said diving board are firmly pressed one against the other. The container 24 is provided with a conduit 26 which is connected with a source of air under pressure so that, if desired the pressure with which the layers are pressed against one another may be greater than one atmosphere.

It will be clear that the invention is not restricted to the embodiments shown in the drawings and described but that they may be modified in many ways without departing from the scope of the invention.

We claim:

1. A diving board for a swimming pool, said diving board being of the cantilever type adapted to have its rear end attached to a stationary support and adapted to rest on an adjustable fulcrum at a fulcrum area between its front and rear ends, said diving board comprising a primary layer substantially extending over its full length, said layer having a low density and an upper surface and a lower surface, at least one of said surfaces being provided with a stack of flat layers of reinforcing material over at least a portion of said surface at both sides of said fulcrum area, said layers of reinforcing material including wire-sheet, the length of each of said wire-sheet layers of said stack successively diminishing from the front end and the rear end of the diving board towards the most rearward portion of the fulcrum area, said wire-sheet layers being bonded to one another and to said surface of the primary layer by a binding material.

2. A diving board according to claim 1, characterized in that the amount of wire-sheet reinforcing material gradually increases from at least one end of said diving board towards the place of the most rearward portion of said fulcrum area.

3. A diving board according to claim 1, characterized in that the ends of the wire-sheet layers have the shape of a triangle and have their apexes on the longitudinal center line of the diving board.

4. A diving board according to claim 1, characterized in that the ends of the wire-sheet layers have the shape of a triangle and have their apexes on the longitudinal center line of the diving board, the apexes of each of the triangles of the end parts of a following layer lying on the bases of the triangles of the end parts of the foregoing layer, the triangles pointing with their apexes towards the rear end of the diving board having smaller perpendiculars than the perpendiculars of the triangles pointing with their apexes towards the front end of said diving board.

5. A diving board according to claim 1, characterized in that its primary layer comprises hollow profiles of resin reinforced with glass fibers, said hollow profiles being made according to the pull-extrusion method.

6. A diving board for a swimming pool, said diving board being of the cantilever type adapted to have its rear end attached to a stationary support and adapted to rest on an adjustable fulcrum at a fulcrum area between its front and rear ends, said diving board comprising a primary layer substantially extending over its full length and having parallel upper and lower surfaces, said primary layer having hollow profiles of resin reinforced with glass fibers made according to the pull-extrusion method, at least one of said parallel surfaces being provided with a stack of flat layers of wire-sheet, the length of each of said wire-sheet layers successively diminishing from the front end and the rear end of the diving board towards the rearward portion of the fulcrum area, said wire-sheet layers being bonded to one another and to said surface of the primary layer by a binding material, the amount of wire-sheet material gradually increasing from both ends of said diving board towards the rearward portion of said fulcrum area.

* * * * *